US006940947B1

(12) United States Patent
Humber et al.

(10) Patent No.: US 6,940,947 B1
(45) Date of Patent: Sep. 6, 2005

(54) INTEGRATED BEARING ASSEMBLY

(75) Inventors: David H. Humber, Saratoga, CA (US); Steve G. Bandy, Sunnyvale, CA (US); Clifford K. Nishimoto, San Jose, CA (US); Gary F. Virshup, Cupertino, CA (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 112 days.

(21) Appl. No.: 10/235,457

(22) Filed: Sep. 5, 2002

(51) Int. Cl.[7] ..... H01J 35/10
(52) U.S. Cl. ..... 378/132; 378/125
(58) Field of Search ..... 378/119–144

(56) References Cited

U.S. PATENT DOCUMENTS

| | | | | |
|---|---|---|---|---|
| 3,694,685 A | | 9/1972 | Houston | |
| 4,674,109 A | | 6/1987 | Ono | |
| 5,091,927 A | | 2/1992 | Golitzer et al. | |
| 5,416,820 A | | 5/1995 | Weil et al. | |
| 5,541,975 A | | 7/1996 | Anderson et al. | |
| 5,559,852 A | * | 9/1996 | Vetter | 378/133 |
| 5,596,621 A | | 1/1997 | Schwarz et al. | |
| 5,737,387 A | * | 4/1998 | Smither | 378/130 |
| 5,875,227 A | * | 2/1999 | Bhatt | 378/132 |
| 5,973,301 A | | 10/1999 | Inoue | |
| 6,011,829 A | | 1/2000 | Panasik | |
| 6,097,789 A | | 8/2000 | Mueller | |
| 6,125,168 A | | 9/2000 | Bhatt | |
| 6,269,146 B1 | * | 7/2001 | Ohnishi et al. | 378/130 |
| 6,636,583 B2 | * | 10/2003 | Ratzmann et al. | 378/133 |

* cited by examiner

*Primary Examiner*—Craig E. Church
*Assistant Examiner*—Jurie Yun
(74) *Attorney, Agent, or Firm*—Workman Nydegger

(57) ABSTRACT

An integrated bearing assembly is provided, comprising a bearing housing defining an axial cavity in which a shaft is disposed. The shaft is rotatably supported by at least two bearing sets. The axial cavity defines three regions, each having distinct diameters. A pair of first regions defines cavity diameters sufficient to receive the bearing sets. A pair of second regions defines cavity diameters such that a small gap is defined between the inner surface of the cavity and the shaft. The third region cooperates with the shaft to define a cylindrical volume containing a coolant. Wettable coatings are utilized in the cylindrical volume to allow free flow of, and maximum contact with, the coolant. Non-wettable coatings are provided in the second regions to contain the coolant. The second regions also function as bearing spacers, thus simplifying bearing assembly design, assembly, and performance.

18 Claims, 4 Drawing Sheets

INTEGRATED BEARING ASSEMBLY

CROSS-REFERENCE TO RELATED APPLICATIONS

Not applicable.

BACKGROUND OF THE INVENTION

1. The Field of the Invention

The present invention generally relates to bearing assemblies. More particularly, the present invention relates to a simplified bearing assembly design that enhances heat dissipation in apparatus such as x-ray generating devices.

2. The Related Technology

X-ray producing devices are extremely valuable tools that are used in a wide variety of applications, both industrial and medical. For example, such equipment is commonly employed in areas such as medical diagnostic examination and therapeutic radiology, semiconductor fabrication, and materials analysis.

Regardless of the applications in which they are employed, x-ray devices operate in similar fashion. X-rays are produced in such devices when electrons are emitted, accelerated, then impinged upon a material of a particular composition. This process typically takes place within an evacuated enclosure, in which is disposed a cathode for emitting electrons, and an anode assembly, which comprises a bearing assembly, a rotor shaft, and an anode mounted to the rotor shaft and oriented to receive the electrons. The rotor shaft, in turn, is rotatably supported by the bearing assembly.

A typical x-ray tube bearing assembly generally comprises a bearing housing having a cylindrical cavity in which is disposed a shaft. Further, first and second bearing sets are disposed near each end of the bearing housing cavity in such a manner as to permit free rotation of the shaft. Each bearing set comprises a plurality of balls confined between an inner race defined by the shaft, and an bearing ring defined by an annular ring disposed within the bearing housing cavity. Also disposed within the housing cavity is a hollow cylindrical bearing spacer concentrically disposed about the central portion of the shaft and interposed between the two bearing sets to maintain a predetermined distance between them.

To produce x-rays, an electric current is supplied to a filament disposed in the cathode, causing the filament to emit a cloud of electrons by thermionic emission. A high electric potential imposed between the cathode and anode causes electrons in the cloud to accelerate toward a target surface located on the anode. Upon striking the target surface, the electrons are decelerated and thereby convert their kinetic energy into electromagnetic radiation of very high frequency, i.e., x-rays. The specific frequency of the x-rays produced depends in large part on the type of material used to form the anode target surface. Target surface materials with high atomic numbers ("Z numbers") are typically employed. The x-rays are then collimated so that they exit the x-ray device through a window disposed in the evacuated enclosure, and enter an x-ray subject, such as a medical patient.

While some of the electrons emitted by the cathode produce x-rays, the majority does not however, and instead convert their kinetic energy to heat upon impact with the anode or other x-ray tube components. A significant amount of the heat created by these electrons is conducted through the anode to the rotor shaft and supporting bearing assembly.

The heat produced by such electrons may, if left unchecked, cause severe damage to the x-ray tube. For instance, the bearing sets disposed in the bearing assembly are especially sensitive to heat. Excessively high temperatures produced in the anode and conducted through the rotor shaft and shaft to the bearing sets can melt the thin metal lubricant that surrounds the bearings, thereby causing the lubricant to disperse and exposing the bearings to excessive friction. The lubricant may also form clumps as a result of excessive exposure to heat, which in turn causes the bearing assembly to operate in a noisy and less smooth manner. Additionally, repeated exposure to high temperatures can gradually degrade the integrity of the bearing surfaces, thereby reducing their useful life or even causing premature bearing failure. These and other effects caused by excessive heating of the anode assembly can ultimately shorten the operational life of the x-ray tube. Therefore, it is important to reliably and continuously dissipate heat from the bearing assembly.

Hollow rotor shafts may be of some benefit in limiting the amount of heat that is conducted from the anode to the bearing assembly because they are relatively more resistant to heat conduction than a solid shaft. In some cases, application of emissive coatings to the rotor shaft may enhance its heat radiation capabilities. Such techniques may not be sufficiently effective in all cases however.

Typically, efficient heat removal from the shaft is hindered by at least two conditions. First, in order for the heat to be removed from the shaft and transmitted to the bearing housing, a significant portion of the heat must pass through the bearing spacer disposed concentrically about the shaft. This configuration implicates a lower rate of heat transfer between the shaft and the bearing housing than is desired. Second, the gap that must exist between the inner diameter of the bearing spacer and the outer diameter of the shaft further slows the rate of heat transfer to the bearing housing. As a result of these conditions, efficient heat transfer between the shaft and bearing housing is prevented, and an unacceptable amount of heat is transmitted to the bearing sets. As described above, such a situation may result in severe damage to the bearing assembly.

Various aspects concerning the assembly of the x-ray tube may be problematic as well. For example, the fit between the outer diameters of the bearing spacer and outer bearing races, and the inner diameter of the cavity of the bearing housing, typically must be tight to maximize contact therebetween and thereby facilitate heat transfer. If the fit is too loose, excessive play will be introduced into the bearing sets, thereby increasing wear and reducing their operational lives. If the fit is too tight, however, particles may be created as the bearing spacer and outer bearing races are inserted into the bearing housing cavity. Later, when the x-ray tube is operated, the particles may migrate to and infiltrate the bearing set. Such particles, may impede bearing motion and significantly increase ball bearing friction, thereby reducing the operational longevity of the bearing sets, and increasing the likelihood of premature bearing failure.

In light of the foregoing, a need therefore exists for a bearing assembly that includes features directed to maximizing the rate at which heat can be transferred away from the bearing assembly. Further, the bearing assembly should be easy to assemble and should facilitate reliable operation of the x-ray device.

BRIEF SUMMARY OF VARIOUS FEATURES OF THE INVENTION

The present invention has been developed in response to the current state of the art, and in particular, in response to the above described and other problems and needs that have not been fully or adequately addressed.

Briefly summarized, embodiments of the present invention are directed to an integrated bearing assembly including various features directed to enhancing the rate at which heat can be transferred away from the bearing assembly. The integrated bearing assembly is designed for use in devices having rotating components, such as a rotary anode x-ray tube. Though described below in connection with an x-ray tube, embodiments of the present invention may be utilized in any application where a reliable, thermally conductive bearing assembly is desired.

In one embodiment of the invention, the integrated bearing assembly comprises a bearing housing, a shaft, and at least two bearing sets. As discussed in greater detail below, the shaft and the bearing sets are disposed within an axial cavity defined by the bearing housing. The shaft is rotatably supported within the axial cavity of the bearing housing by the bearing sets, one of which is disposed near each end of the cavity. Each bearing set comprises a plurality of balls disposed between an inner race defined by the shaft, and a bearing ring concentrically disposed about the shaft. The bearing ring of each bearing set is sized to slidingly engage the inner wall of the axial cavity near each end of the bearing housing such that a relatively close fit is achieved between the inner wall and the bearing ring.

The axial cavity defined by the bearing housing includes various regions of differing diameters. An outer region is defined near each end of the axial cavity of the bearing housing. One of the bearing sets is disposed in each of these outer regions.

The axial cavity further includes two intermediate regions. The intermediate regions are interposed between the outer regions, and each of the intermediate regions is configured such that only a relatively small gap exists between the wall of the axial cavity and the surface of those portions of the shaft that reside in the intermediate regions.

The axial cavity further includes a central region that is interposed between the intermediate regions. The wall of the axial cavity in the central region is configured so that a gap is defined between the wall of the axial cavity and the surface of that portion of the shaft that resides in the central region.

As suggested above, various features are associated with each of the three regions of the axial cavity. For example, the outer regions house the bearing sets, as explained above. As another example, the gap partially defined by the central region is filled with a coolant, such as liquid gallium, to promote the efficient transfer of heat from the shaft to the bearing housing. The gap may be filled with the coolant by way of a fill hole defined by the bearing housing.

Additionally, the relatively small gap between the wall of the axial cavity and the shaft in the intermediate regions permits the shaft to rotate within the cavity, while at the same time, preventing the coolant disposed in the gap defined between the central region and the shaft, from escaping. To assist in the containment of the coolant, the surfaces of the shaft and the wall of the axial cavity in the intermediate regions are coated with non-wettable coatings. In this way, the bearing sets disposed in either outer region are largely protected from contaminating, or being contaminated by, the coolant.

In addition to containing the coolant disposed in the central region gap, the intermediate regions of the axial cavity also serve to maintain the bearing sets in their respective positions within the outer regions of the axial cavity. The elimination of a separate bearing spacer simplifies construction of the bearing assembly, and also results in improved heat transfer from the shaft to the bearing housing. Consequently, excessive heat build up in the bearing sets is substantially minimized and the life and performance of the bearing sets thereby extended.

These and other advantages and features of the present invention will become more fully apparent from the following description and appended claims as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof that are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to figures wherein like structures will be provided with like reference designations. It is understood that the drawings are diagrammatic and schematic representations of presently preferred embodiments of the invention, and are not limiting of the present invention nor are they necessarily drawn to scale. FIGS. 1 through 4 depict selected features of embodiments of the present invention, which, in general, are directed to an integrated bearing assembly suitable for use with devices having rotational components, a rotary anode x-ray tube, for example. While the embodiments described herein are discussed in connection with an x-ray tube, other devices may also benefit from incorporation of the various features disclosed herein.

Figure 1:
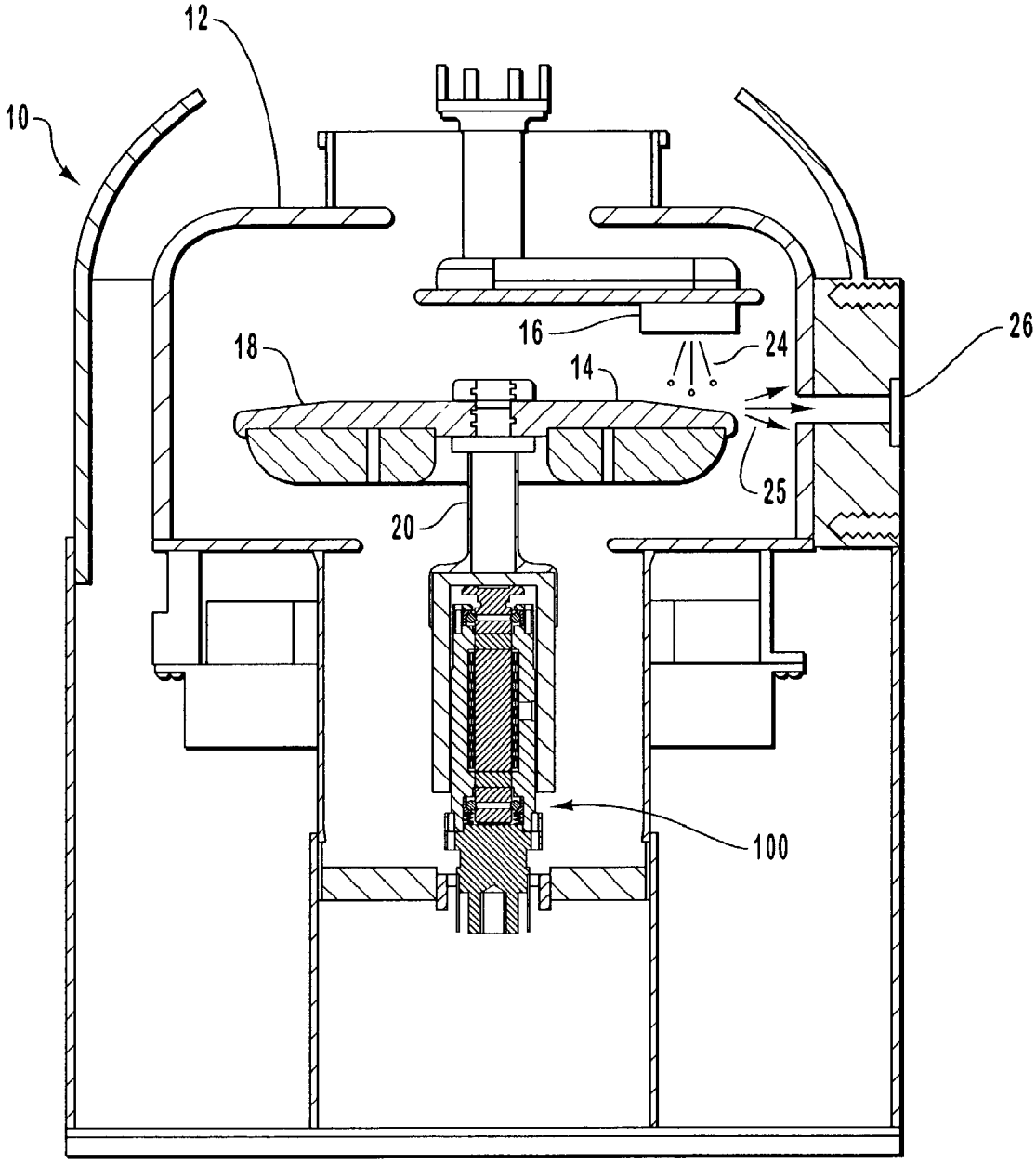
FIG. 1 is a cross sectional side view illustrating various features of an embodiment of an x-ray tube.

Reference is first made to FIG. 1, which depicts an x-ray tube 10. The x-ray tube 10 includes a vacuum enclosure 12. A rotary anode 14, and a cathode 16 are disposed inside the vacuum enclosure 12. The anode 14 is configured and arranged to receive electrons emitted by a filament (not shown) disposed in the cathode 16. A target surface 18, typically comprising a heavy metallic material such as tungsten, is disposed on the top surface of the anode 14. The anode 14 is attached to a support stem 20 that is rotatably supported by the integrated bearing assembly 100. This arrangement allows the anode 14 to be rotated during tube operation by a motor, such as a stator (not shown). Preferably, rotor shaft 20 comprises a hollow shaft. Such a rotor shaft configuration results in a relatively small cross sectional area, and desirably, a correspondingly limited heat transmission capability.

In order for the x-ray tube 10 to produce x-rays, the anode 14 and/or cathode 16 is electrically biased such that a high voltage potential is established between the cathode 16 and the anode 14. An electric current is then passed through the filament, causing a cloud of electrons, designated at 24, to be emitted from the filament by thermionic emission.

An electric field created by the high voltage potential existing between the anode 14 and the cathode 16 causes the electron stream 24 to accelerate from the cathode 16 toward the target surface 18 of the anode 14. As the electrons 24 accelerate toward the target surface 18, they gain a substantial amount of kinetic energy. Upon approaching and impacting the anode target surface 18, many of the electrons 24 are rapidly decelerated, thereby converting their kinetic energy into electromagnetic waves of very high frequency, i.e., x-rays. The resulting x-rays, designated at 25, emanate from the anode target surface 18 and are collimated through a window 26 disposed in the vacuum enclosure 12. The collimated x-rays 25 can then be used in any one of a number of applications, such as x-ray medical diagnostic examination or materials analysis procedures.

Figure 2:
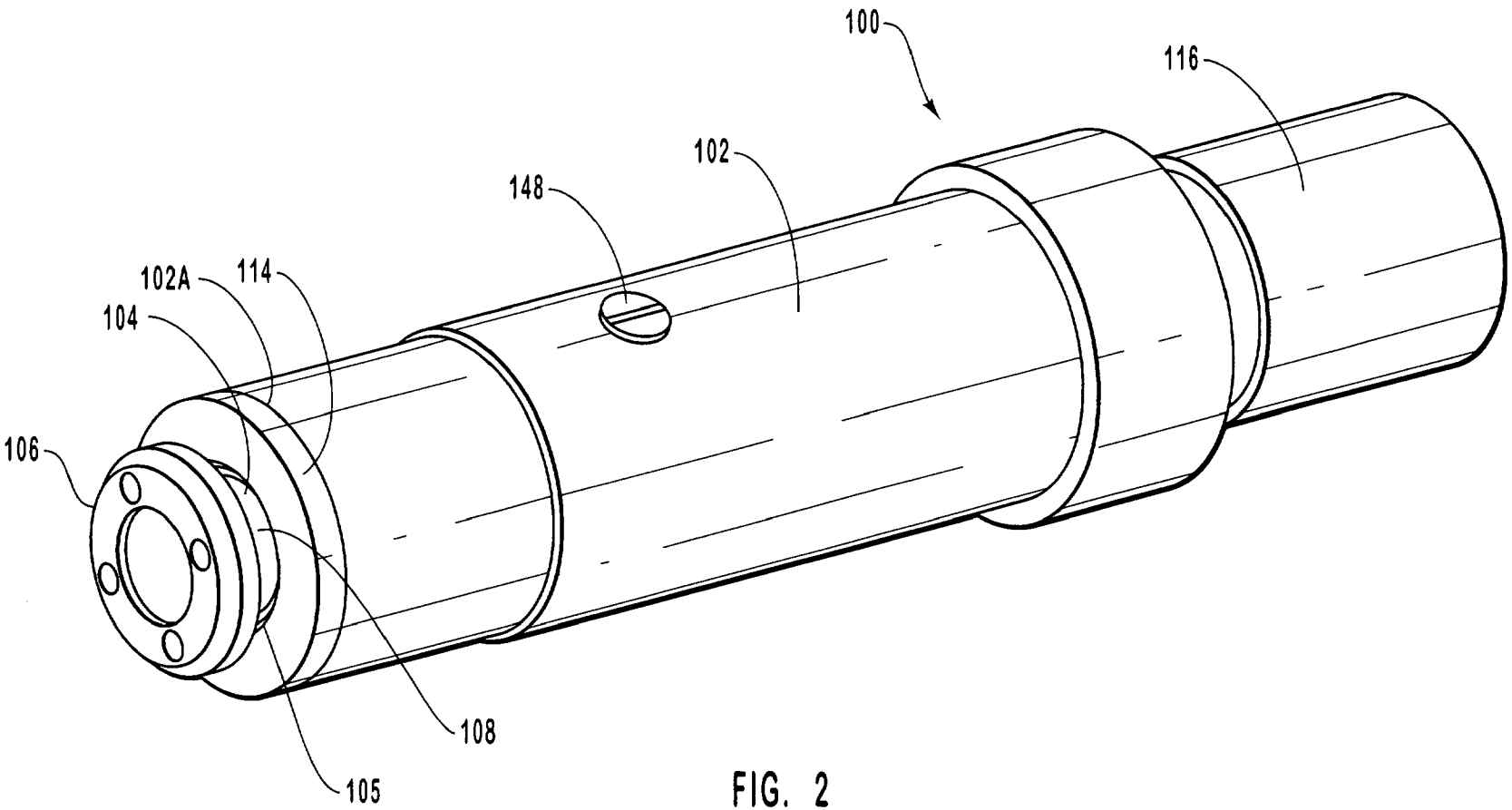
FIG. 2 is a perspective view illustrating various features of an embodiment of an integrated bearing assembly.
Figure 3:
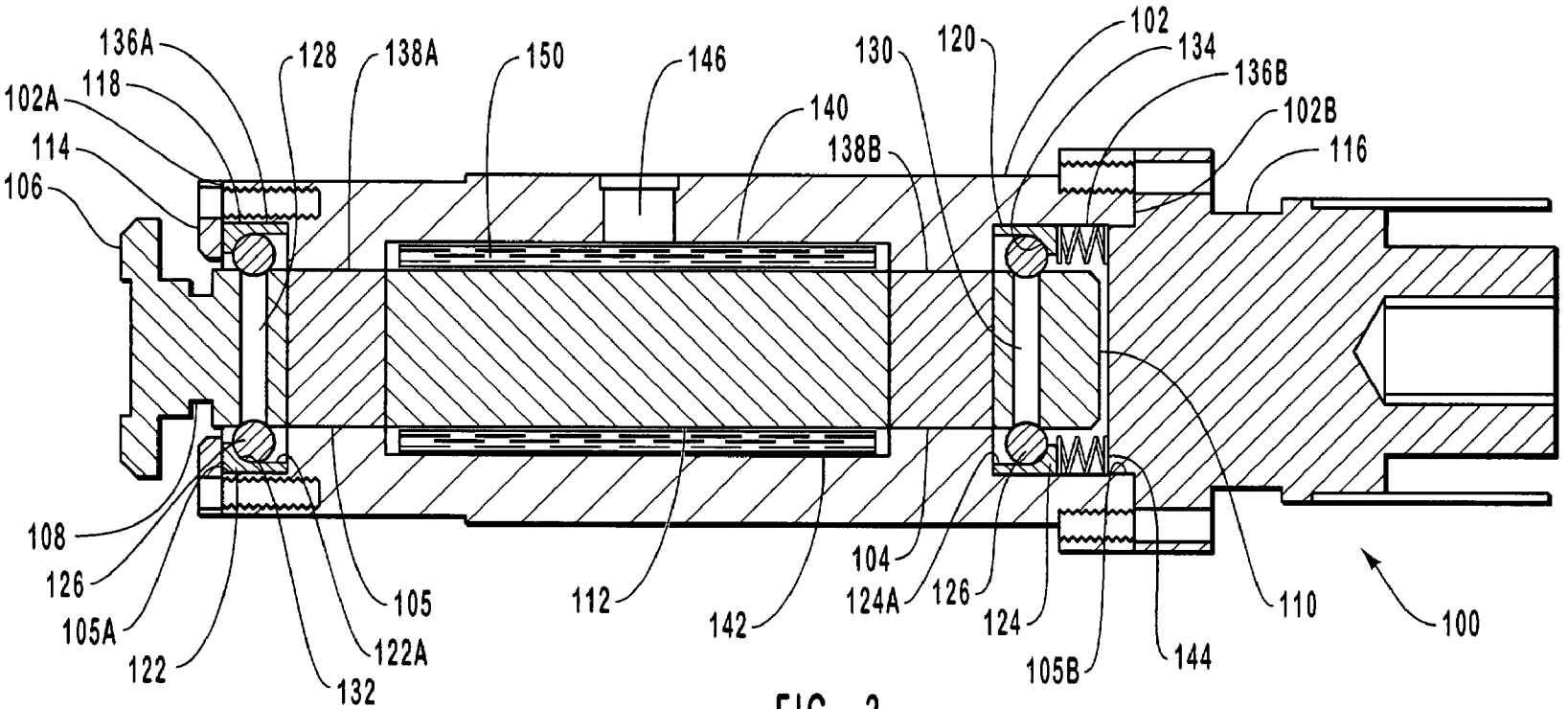
FIG. 3 is a cross sectional side view illustrating various features of an embodiment of an integrated bearing assembly.

Reference is now made to FIGS. 2 and 3, which depict various features of one embodiment of the integrated bearing assembly 100. As mentioned above, the integrated bearing assembly 100 rotatably supports the rotor shaft 20 and the anode 14. In addition, the integrated bearing assembly 100 is configured to, among other things, effectively and efficiently reject heat. Integrated bearing assembly 100 generally comprises a bearing housing 102, a shaft 104 and first and second bearing sets 118 and 120.

The bearing housing 102 comprises an elongated cylindrical shape, and defines a cylindrical axial cavity, generally designated at 105, disposed about a longitudinal axis defined by the bearing housing 102. The shaft 104, formed as a solid cylinder having a first end 108, a second end 110, and a middle portion 112, is substantially disposed within the axial cavity 105 defined by the bearing housing 102. A first end 102A of the bearing housing 102 has affixed thereto a front cap 114 that partially covers a first end 105A of the axial cavity 105. The front cap 114 defines an aperture through which the first end 108 of the shaft 104 extends. Generally, the front cap 114 assists in preventing foreign matter from entering, or leaving, the axial cavity 105 and may be affixed to the bearing housing first end 102A in a variety of ways including, but not limited to, screw fasteners, brazing, welding or intermeshing threads.

A bearing hub 106 is provided on the first end 108 of the shaft 104. The bearing hub 106 is utilized to connect the integrated bearing assembly 100 with the anode 14 by way of the rotor shaft 20. Bolts or machine screws are preferably utilized to attach the bearing hub 106 to the rotor shaft 20.

A rear shank 116 is disposed on a second end 102B of the bearing housing 102. Preferably, the rear shank 116 seals the second end 105B of the axial cavity 105, thereby assisting in preventing foreign matter from entering, or exiting, the axial cavity 105. By way of example and not limitation, the rear shank 116 may be attached to the bearing housing 102 by way of bolts, welding, brazing, or threaded intermeshing between the bearing housing second end 102B and the rear shank 116. As best seen in FIG. 1, the rear shank 116 is fixedly attached to a portion of the x-ray tube 10 so as to provide support to the integrated bearing assembly 100, the rotor shaft 20, and the anode 14.

With continuing reference to FIGS. 2 and 3, the shaft 104 of the integrated bearing assembly 100 is disposed within the axial cavity 105 defined by the bearing housing 102 in a manner that permits free rotation of the shaft. As noted earlier, two bearing sets 1118 and 120 are disposed within the axial cavity 105, one each near ends 105A and 105B of the axial cavity 105, and serve to rotatably support the shaft 104. Each bearing set 118 and 120 includes bearing rings 122 and 124, respectively, a plurality of balls 126, and inner races 128 and 130 defined by shaft 104. In one alternative embodiment, the integrated bearing assembly is configured such that the bearing housing 102 rotates about the shaft 104.

Each bearing ring 122 and 124 is sized to fit against the inner wall of the axial cavity 105, and defines respective bearing rings 122 and 124A respectively. Bearing rings 122 and 124 further include shoulders 132 and 134, respectively, that serve to establish and maintain the radial and axial positioning of the bearing sets 118 and 120 and the shaft 104. As best seen in FIG. 3, the bearing rings 122 and 124 are preferably oriented within the axial cavity 105 such that the shoulders 132 and 134 serve to urge the balls 126 axially inward.

The inner races 128 and 130 cooperate with the shoulders 132 and 134 of the bearing rings 122, 124 to confine respective sets of balls 126. Generally, this arrangement permits motion of the balls 126 about the circumference of shaft 104, but prevents significant axial motion of balls 126. As a result, the shaft 104 is able to rotate, thereby enabling the rotation of the rotor shaft 20 and the anode 14. Preferably, no more than eight (8) balls 126 are disposed in each bearing set 118 and 120 in order to minimize collisions between the balls, and thereby minimize noise and vibration within the bearing sets 118 and 120. However, alternative numbers of balls 126 may be employed. Similarly, more than two bearing sets may be employed in the integrated bearing assembly 100, and such bearing sets may comprise components distinct from those described herein. Accordingly, it should be understood that the foregoing is simply an exemplary embodiment and should not be construed as limiting the scope of the present invention in any way.

Figure 4:
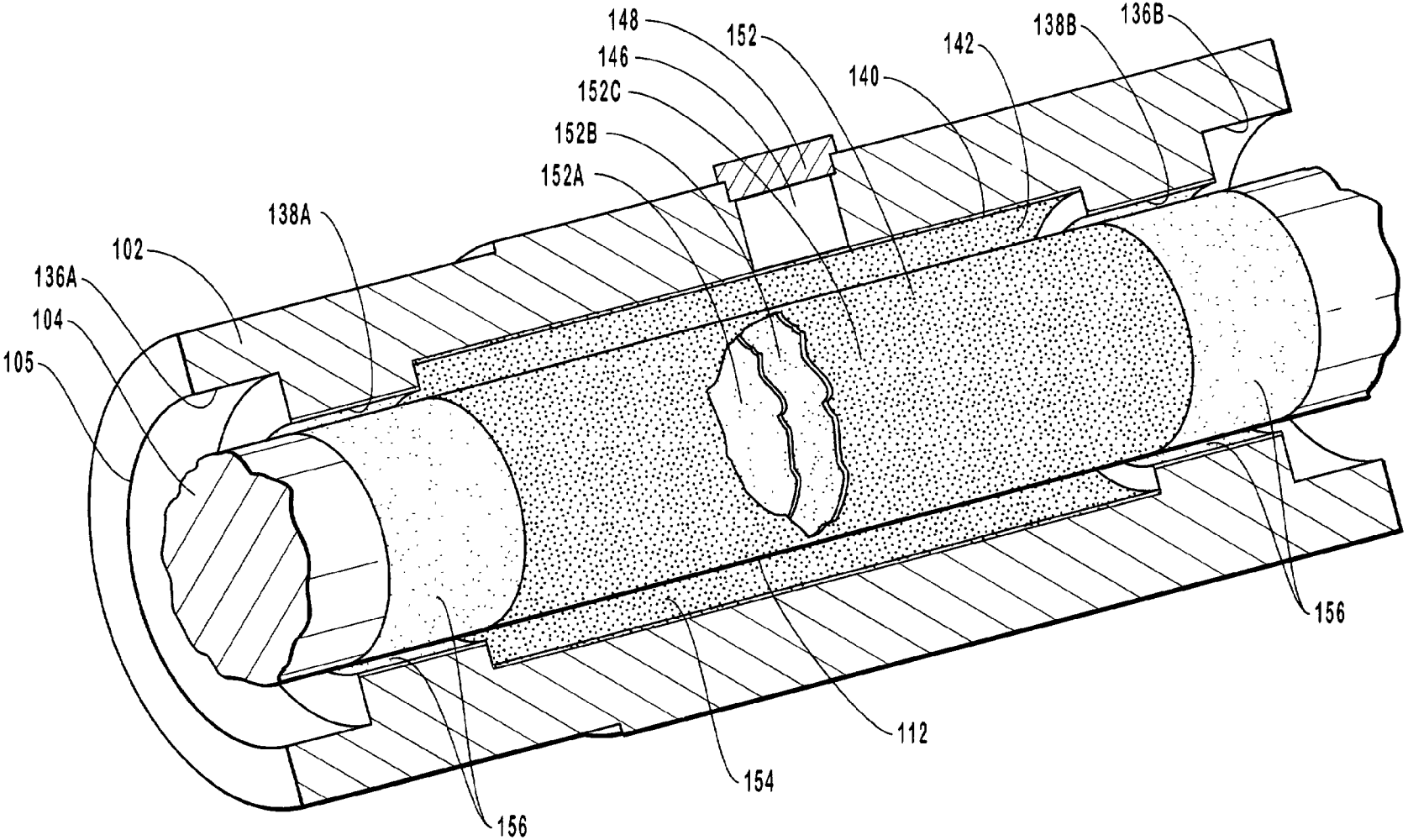
FIG. 4 is a cutaway view illustrating selected features of an embodiment of an integrated bearing assembly.

Directing attention now to FIG. 4, and with continued attention to FIGS. 2 and 3, the axial cavity 105 in which shaft 104 and bearing sets 118 and 120 are disposed preferably defines various distinct regions. In the illustrated embodiment, the axial cavity 105 defines two outer regions 136A and 136B, two intermediate regions 138A and 138B, and a central region 140.

The outer regions 136A and 136B of the axial cavity 105 are disposed proximate first and second ends 102A and 102B, respectively, of the bearing housing 102. One function of each outer region 136A and 136B is to house bearing sets 118 and 120, respectively. To that end, the outer regions 136A and 136B are configured and arranged to closely receive and retain bearing rings 122 and 124, respectively.

A retention force, such as that supplied by a spring 144, may be imposed upon one or both of the bearing sets 118 and 120, to assist in maintaining the bearing sets 118 and 120 in proper axial and radial alignment within the outer regions 136A and 136B, respectively. If desired, a washer (not shown) may be placed next to the spring 144 to ensure that the axial load exerted by the spring is uniformly exerted on the components disposed within the axial cavity 105. Any other structure providing the functionality of spring 144 may alternatively be employed.

The intermediate regions 138A and 138B of the axial cavity 105 are interposed between, and are in communication with, outer regions 136A and 136B. Intermediate regions 138A and 138B are configured and arranged such that only a relatively small gap exists between the inner wall of the axial cavity 105 and the adjacent portion of the shaft 104. In one embodiment, the gap is about 2 mils, or 0.002 inch. Generally, the intermediate regions 138A and 138B cooperate with outer regions 136A and 136B to maintain the bearing sets 118 and 120 in their respective positions. In this way, the intermediate regions 138A and 138B fulfill the function typically provided by bearing spacers in some bearing assemblies. Thus, the need for a separate bearing spacer is eliminated in the integrated bearing assembly 100 because a spacer, and its associated functionality, is essentially integrated into bearing housing 102.

With continuing reference to FIGS. 3 and 4, a central region 140 of the cavity 105 of the bearing housing 102 is interposed between, and are in communication with, intermediate regions 138A and 138B. The central region 140 generally receives the middle portion 112 of the shaft 104, and is configured and arranged to cooperate with shaft 104 to define a central region volume 142. While the geometry of the central region volume 142 may be varied to suit a particular application, the gap between shaft 104 and the wall of axial cavity 105, in the central region, is preferably within a range of from about 0.01 to 0.03 inch in one embodiment of the invention. Note that the number, sizes, and configurations of the various cavity regions specified herein may be varied as may be required depending upon variables such as the intended use of the integrated bearing assembly.

As suggested earlier, some of the heat that is generated in the anode 14 during tube operation is transferred to the shaft 104 by way of the rotor shaft 20. To assist in transferring this heat from the bearing shaft 104 to the bearing housing 102, where such heat may then be removed from the x-ray tube 10 by a cooling system (not shown), a volume of coolant 150 may be disposed in the central region volume 142. The coolant 150 is in continuous contact with the surfaces of both the shaft 104 and the inner wall of the axial cavity of the bearing housing within the central region volume 142. In this way, a conductive path is established between the shaft 104 and the bearing housing 102, thereby enabling any heat transmitted to the shaft during tube operation to be effectively and continuously transferred to the coolant 150, and ultimately to the bearing housing. Consequently, excessive heat buildup in the shaft and the bearing sets 118 and 120 is substantially foreclosed.

In one embodiment, coolant 150 comprises a liquid metal such as gallium. The use of gallium as the coolant 150 is preferred because it flows readily and does not easily vaporize at the low pressure and high temperature operating environment of the x-ray tube. However, any other material(s) that provide the functionality of gallium may likewise be employed. For example, other liquid metals could be utilized as the coolant 150.

In one embodiment, the coolant 150 is introduced into the central region volume 142 through a fill hole 146 defined in the bearing housing 102. A removable fill cap 148 is disposed in the fill hole 146 to prevent escape of the coolant 150 from the central region volume 142. In one alternative embodiment, the coolant 150 is continuously or periodically recirculated into and out of the central region volume 142 in order to further enhance the rate of heat transfer from shaft 104.

In utilizing the coolant 150 within the central region volume 142, it may be necessary to prevent undesired interaction between the coolant 150 and either the inner wall of the axial cavity 105 or the shaft 104. For instance, gallium may undesirably interact with the shaft 104, which typically comprises tool steel and/or with the inner surface of the bearing housing 102, which typically comprises molybdenum. Such interaction may cause the gallium to alloy, thus creating impurities in the coolant 150 and compromising its heat transfer capabilities.

To prevent these, and other, effects, one or more coatings may be applied to selected surfaces of the axial cavity 105 and/or the shaft 104. In general, these coatings implement a wettable interface, which allows the coolant 150 to easily flow over, and come into substantial thermal contact with, the coated surfaces defining the central region volume 142, and thereby enhances the ability of the coolant to remove heat from the shaft 104 and transfer it to the bearing housing 102.

As best seen in FIG. 4, one embodiment of the integrated bearing assembly 100 features a multiple layer coating 152 applied to the middle portion 112 of the shaft 104. The multiple layer coating 152 provides protection and wettability to the shaft 104 as explained above. In one embodiment, the multiple layer coating 152 comprises layers of titanium, silicon carbide, and molybdenum or nickel, applied in that order to the middle portion 112 of the shaft 104. Alternatively, multiple layer coating 152 may comprise additional, or fewer, layers.

The first layer 152A of the multiple layer coating 152 serves to assist the adhesion between the surface of the shaft 104 and the second layer 152B. The first layer 152A comprises titanium, or other similar material, and is applied to the middle portion 112 of the shaft 104 with a thickness in the range of about 500 to about 2,000 angstroms. In one embodiment, layer 152A is about 1,000 angstroms thick. Other materials having the functionality of titanium may alternatively be employed.

The second layer 152B comprises silicon carbide and serves as a thermal expansion buffer between the shaft 104 and the third layer 152C. The second layer 152B is applied on the first layer 152A to a thickness in the range from about 500 to 2,000 angstroms, preferably about 1,000 angstroms.

The third layer 152C comprises molybdenum for providing the desired wettable surface to the shaft 104. The third layer 152C is applied on the second layer 152B to a thickness in the range from about 500 to 2,000 angstroms, preferably about 1,000 angstroms. In place of molybdenum, nickel could be used for the third layer 152C.

While the thicknesses outlined above are preferable ranges for the applied coatings 152A, 152B, and 152C, such thicknesses may be varied as required to suit a particular application. In one alternative embodiment, the titanium layer 152A is omitted as a component of the multiple layer coating 152. In such an embodiment, the second layer 152B is applied directly to the middle portion 112 of the shaft 104.

Though described herein in connection with x-ray tubes, it is noted that the use of the wettable multiple layer coating 152 is not limited solely to x-ray tubes. Indeed, the multiple layer coating 152 may be employed in a variety of applications where the functionality of multiple layer coating 152 is desired. Further, variables including, but not limited to, the thickness, composition, and layering order of layers 152A, 152B and 152C may be varied as required to suit a particular application.

In a manner similar to that described above in connection with the shaft 104, the inner wall in the central region 140 is also coated with a wettable coating to enhance the performance of the coolant 150 disposed within the central region volume 142. An axial cavity coating 154, preferably comprising gold or nickel, is applied to the inner wall of the axial cavity 105 in the central region 140 in a layer having a thickness the range of about 100 to about 500 angstroms, preferably about 300 angstroms. However, the thickness and/or the composition of the coating 154 may be varied as needed for the particular application in which it is employed.

With continuing reference to FIG. 4, the intermediate regions 138A and 138B of the axial cavity 105 serve to contain the coolant 150 within the central region volume 142 in order to prevent the contamination of the bearing sets 118 and 120 by the coolant. The intermediate regions 138A and 138B of the axial cavity 105 include various features calculated to accomplish this result.

For example, the gap between the inner wall of the cavity 105 in the intermediate regions 138A and 138B and the shaft 104 is relatively small. This may be seen in FIG. 4, where the spacing has been exaggerated for clarity. As noted earlier, the size of such gap is preferably about 2 mils (0.002 inch). Such a gap permits axial rotation of the shaft 104, while also serving to help prevent escape of the coolant 150 from the central region volume 142 to the intermediate regions 138A and/or 138B.

Further, a non-wettable coating 156 is applied to the inner wall of the axial cavity 105 in the intermediate regions 138A and 138B and to the adjacent portions of the shaft 104. The non-wettable coating 156 minimizes the attraction between the shaft and axial cavity portions of the intermediate regions 138A and 138B, and the coolant 150, thereby serving as a barrier which substantially contains the coolant 150 disposed in the central region volume 142, and thereby prevents contamination of the bearing sets 118 and 120 by the coolant 150.

The non-wettable coating 156 preferably comprises silicon carbide, or similar material, and is applied in a thickness range of about 500 to about 2,000 angstroms and preferably about 1,000 angstroms. As with the other coatings previously discussed, the thickness and composition of the non-wettable coating 156 may be varied as required to suit a particular application. Further, a variety of other materials could alternatively comprise the non-wettable coating 156. Examples of such other materials include, but are not limited to, carbide compounds, aluminum oxide, titanium dioxide, and quartz. In general, any material(s) providing the functionality of non-wettable coating 156 may be employed.

Finally, the coating 152, the axial cavity coating 154, and the non-wettable coating 156 employed in the integrated bearing assembly 100 may be applied using a variety of application techniques including, but not limited to, sputtering, chemical vapor deposition, and evaporation.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. An x-ray tube, comprising:

a vacuum enclosure having disposed therein a cathode, and an anode positioned to receive electrons emitted by the cathode, the anode being attached to a rotor shaft; and an integrated bearing assembly, comprising:

a shaft attached to the rotor shaft;

a bearing housing defining an axial cavity having an inner wall, wherein a portion of the shaft is received; and two bearing sets disposed within the axial cavity to rotatably support the shaft, and respective portions of the integrated bearing assembly being selectively coated with a wettable coating, and a non-wettable coating.

2. An x-ray tube as defined in claim 1, wherein a volume of coolant is disposed within at least a portion of the axial cavity, the wettable and non-wettable coated portions of the bearing assembly cooperating to facilitate management of the coolant.

3. An x-ray tube as defined in claim 2, wherein the coolant comprises liquid metal.

4. An x-ray tube as defined in claim 3, wherein the coolant comprises gallium.

5. An x-ray tube as defined in claim 1, wherein a portion of the inner wall of the axial cavity and a portion of the shaft are coated with the wettable coating.

6. An x-ray tube as defined in claim 5, wherein the wettable coating that is disposed on the inner wall of the axial cavity has a thickness in a range of about 100 to about 500 angstroms and substantially comprises at least one of: gold; and, nickel.

7. An x-ray tube as defined in claim 6, wherein the wettable coating disposed on the inner wall of the axial cavity has a thickness of about 300 angstroms.

8. An x-ray tube as defined in claim 5, wherein the wettable coating disposed on the portion of the shaft has a thickness in a range of about 1,000 to about 6,000 angstroms.

9. An x-ray tube as defined in claim 8, wherein the wettable coating that is applied to the portion of the shaft has a thickness of about 3,000 angstroms.

10. An x-ray tube as defined in claim 5, wherein the wettable coating disposed on the portion of the shaft comprises an adhesion layer, a thermal expansion buffer layer, and a wettable layer.

11. An x-ray tube as defined in claim 10, wherein the adhesion layer comprises titanium, and wherein the thermal expansion layer comprises silicon carbide, and wherein the wettable layer comprises molybdenum.

12. An x-ray tube as defined in claim 1, wherein a portion of the inner wall of the cavity has disposed thereon a non-wettable coating, and a portion of the shaft has disposed thereon a non-wettable coating.

13. An x-ray tube as defined in claim 12, wherein the non-wettable coating disposed on the inner wall of the cavity-has a thickness in a range of about 500 to about 2,000 angstroms, and the non-wettable coating disposed on the portion of the shaft has a thickness in a range of about 500 to about 2,000 angstroms.

14. An x-ray tube as defined in claim 13, wherein the non-wettable coating disposed on the inner wall of the cavity has a thickness of about 1,000 angstroms, and the non-wettable coating disposed on the portion of the shaft has a thickness of about 1,000 angstroms.

15. An x-ray tube defined in claim 12, wherein the non-wettable coating substantially comprises at least one of the following: carbide compounds;

aluminum oxide; titanium oxide; and, quartz.

16. An x-ray tube as defined in claim 1, wherein the housing of the bearing assembly is configured to permit introduction and retention of coolant in the axial cavity.

17. An x-ray tube, comprising:

a vacuum enclosure wherein a cathode and anode are disposed, the anode being positioned to receive electrons emitted by the cathode; and an integrated bearing assembly, comprising:

a shaft at least indirectly attached to the anode, a portion of the shaft being coated with a wettable coating;

a bearing housing defining a cavity having an inner wall, at least a portion of the inner wall being coated with a wettable coating, and the shaft being at least partially received within the cavity; and two bearing sets disposed within the cavity to rotatably support the shaft.

18. An x-ray tube, comprising:

a vacuum enclosure wherein a cathode and anode are disposed, the anode being positioned to receive electrons emitted by the cathode; and an integrated bearing assembly, one portion of which includes a wettable coating and another portion of which includes a non-wettable coating, the integrated bearing assembly comprising:

a shaft at least indirectly attached to the anode;

a bearing housing defining a cavity having an inner wall, the shaft being at least partially received within the cavity; and two bearing sets disposed within the cavity to rotatably support the shaft.

* * * * *